US008871060B2

(12) United States Patent
Klerelid

(10) Patent No.: US 8,871,060 B2
(45) Date of Patent: Oct. 28, 2014

(54) METHOD AND A MACHINE FOR PRODUCING A STRUCTURED FIBROUS WEB OF PAPER

(75) Inventor: Ingvar Klerelid, Karlstad (SE)

(73) Assignee: Valmet AB, Sundsvall (SE)

( * ) Notice: Subject to any disclaimer, the term of this patent is extended or adjusted under 35 U.S.C. 154(b) by 0 days.

(21) Appl. No.: 14/128,618

(22) PCT Filed: Jul. 9, 2012

(86) PCT No.: PCT/SE2012/050816

§ 371 (c)(1),
(2), (4) Date: Jan. 17, 2014

(87) PCT Pub. No.: WO2013/009256

PCT Pub. Date: Jan. 17, 2013

(65) Prior Publication Data

US 2014/0130997 A1 May 15, 2014

(30) Foreign Application Priority Data

Jul. 12, 2011 (SE) ..... 1150665

(51) Int. Cl.
*D21F 1/48* (2006.01)

(52) U.S. Cl.
USPC ..... 162/217

(58) Field of Classification Search
USPC ..... 162/217, 109–11, 205, 219, 289, 359.1, 162/358.2, 361
See application file for complete search history.

(56) References Cited

U.S. PATENT DOCUMENTS 5,662,777 A 9/1997 Schiel et al.
5,725,734 A 3/1998 Herman et al.
5,830,321 A 11/1998 Lindsay et al.

(Continued)

FOREIGN PATENT DOCUMENTS

EP 2085513 A1 8/2009
WO WO 2009/067079 A1 5/2009

OTHER PUBLICATIONS

International Searching Authority, International Search Report and Written Opinion for International Application No. PCT/SE2012/050816, mailed Oct. 2, 2012, 9 pages, Swedish Patent and Registration Office, Sweden.

*Primary Examiner* — Mark Halpern
(74) *Attorney, Agent, or Firm* — Alston & Bird LLP

(57) ABSTRACT

The invention relates to a method of producing a structured fibrous web of paper. The method comprises forming a fibrous web and conveying the formed fibrous web on a water receiving felt (5) to a dewatering nip. An endless belt (11) with a polyurethane surface is passed through the nip together with the fibrous web and the water receiving felt (5). After the dewatering nip, the fibrous web is conveyed by the endless belt (11) to an endless textured fabric (12) which is permeable to air and to which the web is transferred from the endless belt (11) in a transfer nip. The textured fabric (12) rans at a lower speed than the endless belt (11). After the transfer to the textured fabric (12), the fibrous web is carried by the textured fabric (12) to a drying cylinder (17). The transfer nip is formed by two rolls of which one is a suction roll within the loop of the textured fabric. The transfer nip has a length which is 5 mm-40 mm. The endless polyurethane belt (11) has a width that exceeds the width of the textured fabric (12). The invention also relates to a corresponding machine.

20 Claims, 7 Drawing Sheets

(56) References Cited

U.S. PATENT DOCUMENTS

| | | | | |
|---|---|---|---|---|
| 5,888,347 | A | 3/1999 | Engel et al. | |
| 6,083,352 | A | 7/2000 | Snellman et al. | |
| 6,187,137 | B1 | 2/2001 | Druecke et al. | |
| 6,287,426 | B1 | 9/2001 | Edwards et al. | |
| 7,527,708 | B2 | 5/2009 | Gustavsson | |
| 7,588,660 | B2 | 9/2009 | Edwards et al. | |
| 7,811,418 | B2 * | 10/2010 | Klerelid et al. | 162/358.2 |
| 2008/0156450 | A1 * | 7/2008 | Klerelid et al. | 162/203 |
| 2010/0065234 | A1 * | 3/2010 | Klerelid et al. | 162/111 |
| 2010/0139881 | A1 * | 6/2010 | Beuther et al. | 162/206 |
| 2010/0326616 | A1 * | 12/2010 | Klerelid et al. | 162/205 |
| 2011/0126998 | A1 * | 6/2011 | Klerelid et al. | 162/210 |
| 2012/0267063 | A1 * | 10/2012 | Klerelid et al. | 162/130 |

* cited by examiner

METHOD AND A MACHINE FOR PRODUCING A STRUCTURED FIBROUS WEB OF PAPER

CROSS REFERENCE TO RELATED APPLICATIONS

This application is a national stage application, filed under 35 U.S.C. §371, of International Application No. PCT/SE2012/050816, filed Jul. 9, 2012, which claims priority to and the benefit of Swedish Application No. 1150665-6, filed Jul. 12, 2011, the contents of both of which are hereby incorporated by reference in their entirety.

BACKGROUND

1. Related Field

The invention relates to a method and a machine for producing a structured fibrous web, in particular a tissue web. The fibrous web produced may be used as, for example, kitchen towel, toilet paper or facial tissue.

2. Description of Related Art

A machine for manufacturing structured soft paper is disclosed in U.S. Pat. No. 6,287,426. The machine disclosed in that patent has a forming section with a head box and two forming fabrics. The formed web is passed on a water receiving felt through a dewatering nip. An impermeable belt is also passed through the dewatering nip and the web is transferred to the impermeable belt. The impermeable belt then conveys the fibrous web to a wire 22 which has a web-contacting side with a structure. A suction device placed within the loop of the wire is used to pick up the web from the impermeable belt and transfer it to the structured wire. The web is then passed to a drying cylinder which may be a Yankee dryer. When the web is passed from the impermeable belt to the structured wire, a speed difference is used in order to achieve structuring. This means that the wire moves at a speed that is less than the speed of the impermeable belt. Such a speed difference is sometimes referred to as "rush transfer". It is stated in that document that the speed difference can be 10-25%. While this machine may give a good result in terms of bulk, the inventor of the present invention has discovered that the paper web may sometimes be damaged. The inventor of the present invention has found that it is difficult to operate such an arrangement at speed differences larger than about 8%. When the speed difference is larger than about 8%, sheet transfer is often lost and the web is damaged. It is therefore an object of the present invention to reduce the risk that the paper web is damaged, even when the speed difference is larger than 8%.

U.S. Pat. No. 7,588,660 discloses another machine for manufacturing structured soft paper. In that patent, the formed web is transferred to a felt and passed through a single-felted dewatering nip in which the fibrous web is passed to a transfer roll. From the transfer roll, the web is passed through a nip to a creping fabric. Such an arrangement requires that three rolls cooperate which is difficult due to deflection of the rolls in the nips. Moreover, the creping wire may be subjected to wear as it contacts the transfer roll.

Another machine for producing paper webs is disclosed in U.S. Pat. No. 6,187,137, That document discloses how a wet web may be transferred first from the forming section to a first transfer fabric and from the first transfer fabric to a second transfer fabric which may be adapted to impart texture and bulk to the web, Transfer to the second transfer web may be done by means of rush transfer whereafter the web may be transferred to a cylindrical dryer.

Yet another machine is discussed in U.S. Pat. No. 5,830,321, In that patent, rush transfer is discussed and the transfer takes place when the fabrics involved pass over a vacuum shoe and a deflection element respectively.

BRIEF SUMMARY

The invention relates to a method of producing a structured fibrous web of paper. The method comprises forming a fibrous web and conveying the formed fibrous web on a water receiving felt to a dewatering nip (a press nip in which water is pressed out of the web). The dewatering nip is formed by a first press unit and a second press unit. An endless belt is passed through the nip together with the fibrous web and the felt. The endless belt has a side which is covered by polyurethane and which contacts the fibrous web in the dewatering nip. The method further comprises the step that after the dewatering nip, the fibrous web is conveyed by the endless belt to an endless textured fabric/textured belt which is permeable to air and to which the web is transferred from the endless belt. The textured fabric is running at a lower speed than the endless belt. After the transfer to the textured fabric, the fibrous web is conveyed by the textured fabric to a drying cylinder. The web is transferred from the endless belt to the textured fabric in a transfer nip formed between a first transfer nip roll that lies within the loop of the endless belt and a second transfer nip roll which is a suction roll located within the loop of the textured fabric. The transfer nip has a length in the machine direction which is in the range of 5 mm-40 mm, preferably 15 mm-30 mm.

The first transfer nip roll and the endless belt may advantageously have a width that exceeds the width of the textured fabric.

The drying cylinder is preferably a Yankee cylinder from which the web is creped but it could also be, for example, a through air drying cylinder, i.e. a TAD cylinder.

The endless belt may have a speed that is 5%-25% higher than the speed of the textured fabric or 8%-25% higher than the speed of the textured fabric. In many practical embodiments, a speed that is 10%-15% higher than the speed of the textured fabric can be used.

The linear load in the transfer nip may be in the range of 0.5 kN/m-15 kN/m.

The second transfer nip roll may operate with an internal underpressure in the range of 10 kPa-70 kPa or within a narrower range of 10 KPa-40 KPa.

In advantageous embodiments of the invention, the endless belt has an air permeability that does not exceed 0.15 m/s (measured at a pressure difference of 125 kPa between the opposing sides of the endless belt). The value of 0.15 m/s corresponds to 35 CFM. The unit CFM (cubic feet per minute) is not an SI-unit but it is the normally used unit for air permeability within the art of paper making. Preferably, the endless belt is a smooth belt, i.e. a belt that has a smooth surface. At least the side that faces the fibrous web in the dewatering nip should preferably have a smooth surface.

Preferably, the belt is a smooth belt that is impermeable to water. However, embodiments are conceivable in which the belt is a textured belt that can give a three-dimensional structure to the side of the paper web that is contacted by the belt. Thereby, the web can become structured on both sides (i.e. get a three-dimensional structure on both sides).

In embodiments of the invention, the textured fabric may optionally pass a vacuum box that operates at an underpressure such that the fibrous web is further molded into the textured fabric before the fibrous web reaches the drying cylinder.

The vacuum box may operate at an underpressure of 20 kPa-70 kPa.

The invention also relates to a machine for producing a structured fibrous web of paper. The machine comprises a forming section that includes a first and a second forming fabric; a dewatering nip formed by a first and a second press unit through which dewatering nip a water receiving felt is arranged to carry a fibrous web formed in the forming section; an endless belt arranged to run in a loop through the dewatering nip and having at least one side covered with polyurethane such that the polyurethane covered side will face the paper web that passes through the dewatering nip; a textured fabric arranged to pick up the paper web from the endless belt at a point downstream of the dewatering nip; and a drying cylinder to which the textured fabric is arranged to carry the paper web. The machine further comprises a transfer nip in which the paper web is transferred from the endless belt to the textured fabric. The transfer nip is formed by a first transfer nip roll located within the loop of the endless belt and a second transfer nip roll which is a suction roll that is located within the loop of the textured fabric. The transfer nip has a nip length in the machine direction that is in the range of 5 mm-40 mm, preferably 15 mm-30 mm.

Preferably, the first transfer nip roll and the endless belt have a width that exceeds the width of the textured fabric. Suitably, the width of the first transfer nip roll and the width of the endless belt may have a width that exceeds the width of the textured fabric by 10 mm-300 mm, One of the first and second press units in the dewatering nip may be an extended nip roll.

In advantageous embodiments of the invention, the transfer nip is located at a distance of 1 m-7 m from the dewatering nip, preferably 2 m-6 m.

A vacuum box may be optionally arranged to act on the textured fabric to further mold the web into the surface of the textured fabric (by means of suction due to the underpressure in the vacuum box) to further increase the bulk of the web. The fibrous web is thus further molded into the surface of the textured fabric by the vacuum in the vacuum box. This takes place before the fibrous web reaches the drying cylinder. The underpressure in the vacuum box acts through the textured fabric which is permeable to air. Thereby, the vacuum box also acts on the web such that the web is molded into the surface of the textured fabric. The vacuum box is located at a point between the transfer nip and the drying cylinder.

In some embodiments, the drying cylinder is a Yankee drying cylinder to which the paper web is transferred from the textured fabric in a second transfer nip formed between a nip roll and the Yankee cylinder. In such embodiments, a doctor blade may preferably be arranged to act on the Yankee cylinder.

In other embodiments, the drying cylinder may be a through air drying cylinder which is wrapped by the textured fabric over a part of its circumference.

In advantageous embodiments, the endless belt may have an air permeability that does not exceed 0.15 m/s (35 CFM).

The water receiving felt that passes through the dewatering nip may advantageously also be one of the forming fabrics in the forming section.

DETAILED DESCRIPTION OF VARIOUS EMBODIMENTS

Figure 1:
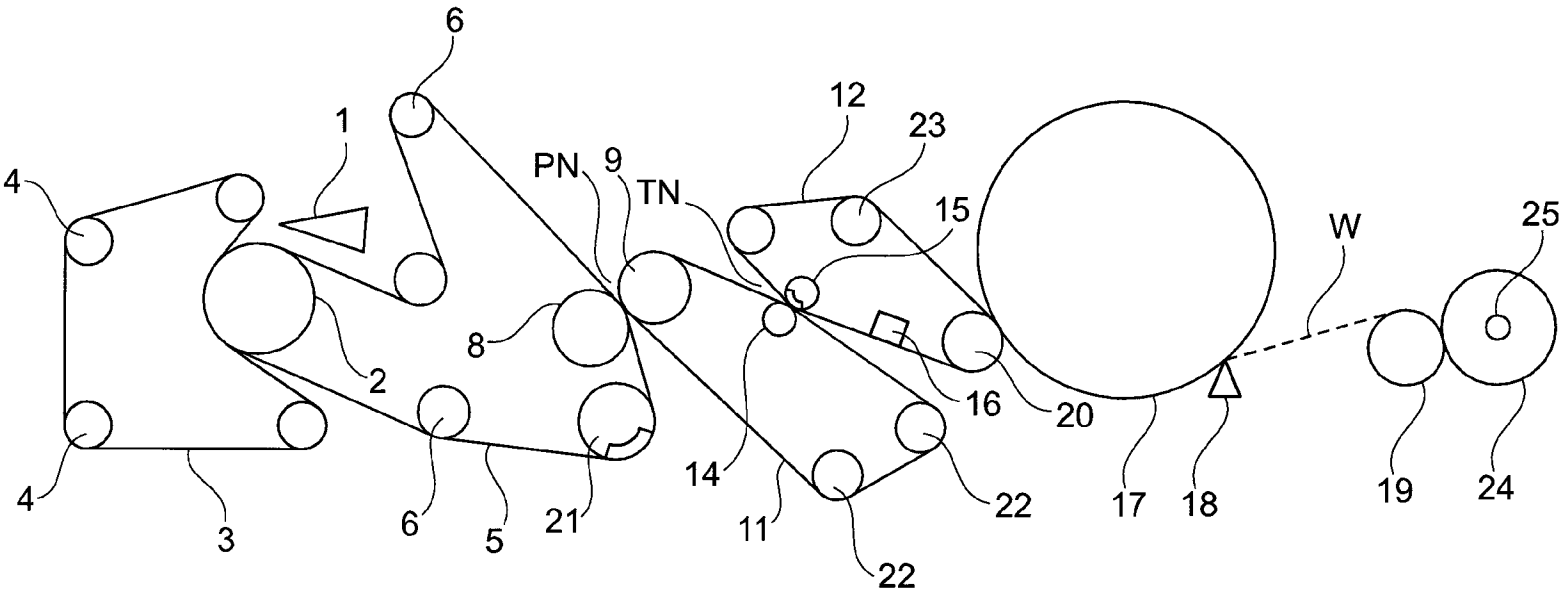
FIG. 1 shows a schematic side view of a first embodiment of the invention in which a Yankee drying cylinder is used.

With reference to FIG. 1, a machine for producing a structured fibrous web of paper is shown. The machine comprises a forming section. The forming section has a head box 1 that is arranged to inject stock into a gap between a first forming fabric 3 and a second forming fabric 5. Both forming fabrics 3, 5 may be foraminous wires (i.e. wires that are permeable to water). However, in advantageous embodiments, the first forming fabric 3 is a foraminous wire while the second forming fabric 5 may be a water receiving felt. It should be understood that, in the context of this patent application and any patent issuing therefrom, the term "forming fabric" is used for any fabric used during forming of the fibrous web. This could include both foraminous wires and felts.

The reference numeral 2 designates a forming roll. In FIG. 1, it is shown how the first forming fabric 3 is arranged to run in a loop guided by guide rolls 4. The second forming fabric 5 is guided by guide rolls 6. The newly formed web is carried on the outer surface of the felt 5 to a dewatering nip PN (i.e. a press nip PN) formed between a first press unit 8 and a second press unit 9. In the embodiment of FIG. 1, the felt that passes through the dewatering nip is identical to one of the forming fabrics. It should be understood that embodiments are conceivable in which web is first formed between two forming fabrics and then transferred to a felt which is not used as a forming fabric. However, the overall design of the machine becomes more compact when one of the forming fabrics is the same felt that carries the web to the dewatering nip PN. The press units 8, 9 will normally be formed by rolls such as for example deflection controlled rolls. In the dewatering nip PN, water is pressed out of the fibrous web such that the dry solids content of the web increases. Dry solids content after the dewatering nip PN may be in the range of 40%-50%. Optionally, a suction roll 21 may also be arranged within the loop of the second forming fabric 5 to dewater the felt and the newly formed web by vacuum dewatering. An endless belt 11 is also arranged to pass through the dewatering nip PN together with the felt 5 and the web W. The endless belt 11 forms a loop and may be guided by guide rolls 22. At least the side of the endless belt 11 that faces the paper web is covered by polyurethane such that the polyurethane-covered side of the endless belt 11 will face the paper web when the web and the endless belt 11 pass through the dewatering nip. The polyurethane-covered side of the endless belt 11 is smoother than the felt. Therefore, the web will adhere to the polyurethane-covered endless belt 11 after passage of the dewatering nip PN. After the dewatering nip PN, the web is carried by the endless belt 11 to a transfer nip TN downstream of the dewatering nip PN which transfer nip TN is formed by a first transfer nip roll 14 located within the loop of the endless belt 11 and a second transfer nip roll 15 which is a suction roll. A textured fabric 12 runs in a loop through the transfer nip TN and the textured fabric 12 may be guided by one or several guide rolls 23. The second transfer nip roll 15 is located within the loop of the textured fabric 12. The textured fabric 12 is arranged to pick the web from the endless belt 11 when the web passes the transfer nip TN such that the web is transferred to the textured fabric 12. The transfer is secured by means of the second transfer nip roll 15 since this roll is a suction roll. The textured fabric 12 is air permeable such that the second transfer nip roll 15 may draw air through the textured fabric and cause the web to adhere to the textured fabric. The air permeable textured fabric 12 may be a woven fabric such as a forming wire or a through air drying fabric (TAD fabric). The smooth surface of the polyurethane-covered endless belt 11 makes the web adhere to the endless belt but the adhesive force is not very strong and the web can be picked up quite easily from the endless belt 11 without substantial risk of web breaks.

The textured fabric has a texture, i.e. a three-dimensional structure on at least the side facing the paper web. The textured fabric 12 imparts a three-dimensional structure on the web when the second transfer nip roll 15 (the suction roll) draws the web by suction against the textured fabric 12. Thereby, the bulk of the web is increased. To further increase the bulk of the web, the transfer from the endless belt 11 to the textured fabric 12 is made in the form of a rush transfer, i.e. there is a speed difference between the textured fabric 12 and the endless belt 11. Using a certain degree of speed difference helps sheet transfer if the difference in speed is not too large. However, speed differences above a certain limit can actually make sheet transfer more difficult. The difference in speed may also improve bulk. When the paper web is picked up by a textured fabric, the speed difference may also contribute to improving the molding of the web into the textured fabric, thereby further improving the bulk.

The polyurethane-covered endless belt 11 is preferably a belt with a smooth surface and impermeable to water and air. An endless belt 11 with a textured surface (on the side facing the fibrous web W) and which is impermeable to water and air is considered not quite as advantageous but almost as good as a smooth and impermeable belt. However, embodiments are also conceivable in which the polyurethane-covered endless belt 11 has a limited permeability to air. The permeability to air should not exceed 0.15 m/s (corresponding to 35 CFM) at a pressure drop of 125 kPa between opposite sides of the belt. If the endless belt 11 is permeable to air, a smooth belt is the most preferred choice but a textured belt with a limited permeability (not more than 0.15 m/s) can be considered.

The use of a polyurethane-covered belt (the endless belt 11) is advantageous for sheet transfer. In the dewatering nip PN, the surface of the fibrous web will tend to adhere to the polyurethane surface and will follow the endless belt 11 after the dewatering nip PN instead of following the felt. However, as the web passes through the dewatering nip PN and water is forced out of the web, the dry solids content of the web increases. Compared to a web with low dry solids content, a dryer web has less adherence to the surface of a transfer fabric such as the endless belt 11. Therefore, when the web W becomes dryer, it will become easier to transfer the web W to a following fabric. Immediately after the dewatering nip PN, the web tends to adhere relatively well to the polyurethane-covered endless belt 11. The inventor has observed that adherence of the fibrous web W to the endless belt 11 decreases with time after passage of the dewatering nip. Without wishing to be bound by any particular theory, it is believed by the inventor that a thin water film is present on the endless belt 11 immediately after the nip and that this thin water film creates adhesion between the endless belt 11 and the fibrous web W. The polyurethane-covered endless belt 11 is compressed in the dewatering nip PN and expands after the nip. It is believed by the inventor that this expansion of the endless belt 11 may cause the water film to break up. When this happens, adhesion decreases. The expansion of the endless belt 11 comes gradually such that adhesion also decreases gradually. Therefore, adhesion decreases with time. Regardless of whether this explanation is correct or not, experience has showed the inventor that adhesion decreases gradually after the dewatering nip PN. For this reason, the distance from the dewatering nip PN to the transfer nip TN should preferably be at least 1 m to give the endless belt 11 time to expand. In some cases, the distance may have to be larger, up to 7 m. It should be understood that the distances mentioned are applicable to applications using a speed which is in the normal range of speed for a tissue making machine, Presently, (July, 2011) new tissue making machines may operate at a speed of up to about 2000 m/minute.

The degree of adhesion of the fibrous web W to the endless belt 11 is important. In and immediately after the dewatering nip PN, the adhesion of the fibrous web W to the endless belt 11 is high such that the fibrous web follows the endless belt 11 instead of following the water receiving felt 5. After the dewatering nip PN, the adhesion of the fibrous web W to the endless belt 11 decreases such that the fibrous web can easily be picked up by the endless textured fabric 12.

In many realistic embodiments of the invention, the endless belt 11 may run 10%-15% faster than the textured fabric 12 or 8%-15% faster than the textured fabric 12. However, it is desirable that the speed difference is can be made even larger. Therefore, speed differences up to 25% may sometimes be considered to further increase the bulk of the web. The inventor of the present invention has found that when the length of the transfer zone is too long, this may cause damage to the web in connection with rush transfer. Without wishing to be bound by theory, it is believed that, if the transfer zone is too long, this may lead to higher shearing stress in the web. The higher the speed difference is, the greater the risk that the web be damaged. Since a higher speed difference is desired in order to obtain higher bulk, it is highly desirable that the speed difference can be increased without simultaneously increasing the risk that the web be damaged. The inventor has found that the maximum length of the transfer zone should not exceed 40 mm and preferably it should not exceed 30 mm. By using a transfer nip between two rolls 14, 15, it is possible to ensure that the transfer nip can be kept short in the machine direction. Suitably, the length of the transfer nip in the machine direction is 5 mm-30 mm, preferably 15 mm-30 mm. For example, it may be 25 mm. A nip length less than 5 mm is considered impractical. The inventor has found that, when transfer is carried out by means of only a suction shoe as in U.S. Pat. No. 6,287,426 or by means of only suction roll acting on one side of the web, the transfer zone becomes extended and it becomes correspondingly more difficult to achieve reliable web transfer without web damage, especially when the speed difference is larger than 8%. A short transfer zone can be achieved by means of a nip formed between two rolls. Thereby, the transfer can be carried out even reliably and without damage to the web even at speed differences exceeding 8%.

Figure 6:
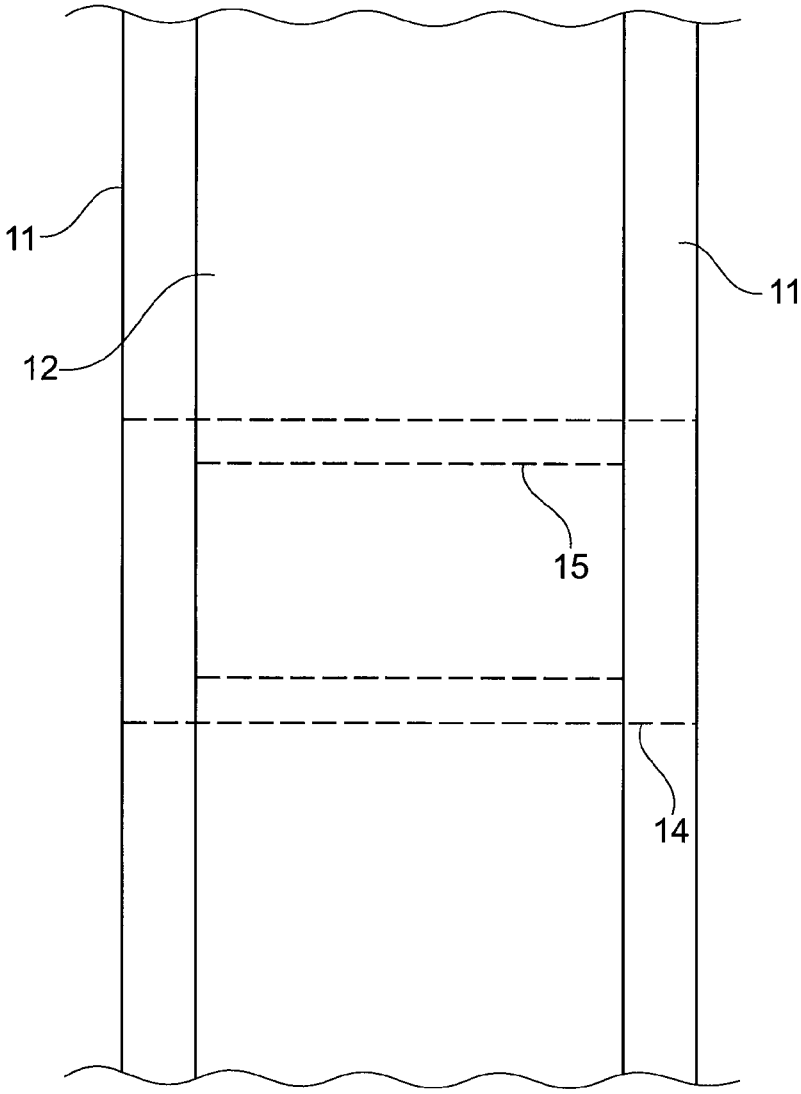
FIG. 6 shows a view from above of the transfer nip.

The textured fabric 12 may also risk being damaged in the transfer nip in case its edges should contact the first transfer nip roll 14. This problem is not so serious when there is no speed difference. However, when a speed difference is used in the transfer zone, the problem may become more significant. Damage to the edges of the transfer fabric may also cause damage to the web. To solve or at least reduce this problem, the width (i.e. the extension in the cross machine direction) of the endless belt 11 can optionally be made larger than the width of the textured fabric 12. In the same way, the width of the first transfer nip roll 14 suitably exceeds the width of the textured fabric 12 such that it can support the endless belt 11 over the entire width of the endless belt 11. When the endless belt 11 with its polyurethane covered side has a greater width than the textured fabric 12, the textured fabric 12 is protected by the endless belt 11. Preferably, also the width of the first transfer nip roll 14 exceeds the width of the second transfer nip roll 15 (the suction roll). The width of the endless belt 11 may exceed the width of the textured fabric by 10 mm-300 mm. With reference to FIG. 6, it can be seen that the endless belt 11 is wider than the textured fabric 12.

Preferably, the endless belt 11 is impermeable. If it is not entirely impermeable, the permeability to air should preferably not exceed 0.15 m/s measured at a pressure differential of 125 kPa between the two opposite sides of the endless belt 11.

After the transfer nip TN, the web is carried by the textured fabric 12 to a drying cylinder 17. In the embodiment of FIG. 1, the drying cylinder 17 is a Yankee drying cylinder and the web is transferred to the drying cylinder in a second transfer nip formed by a nip roll 20 and a the drying cylinder 17. The web W can then be passed on the drying cylinder to a doctor blade 18 that crepes the web W from the drying cylinder 17. The drying cylinder 17 is internally heated by for example steam. The drying cylinder thereby causes water to evaporate from the web W. When the web W has been separated from the surface of the drying cylinder 17, it can be passed to a reel-up. In FIG. 1, it is shown how a paper roll 24 is formed in a reeling drum 25. The reference numeral 19 refers to a supporting cylinder. Although the drying cylinder 17 must not necessarily be a Yankee cylinder, it is preferred that the drying cylinder is a Yankee cylinder from which the web is creped.

The linear load in the transfer nip is in the range of 0.5 kN/m-15 kN/m. This is a range which may be suitable for a lightly loaded transfer nip in which the nip mainly serves to transfer the web from one fabric to another. The low load contributes to protect the web from damage. However, that a certain load is applied (as opposed to no load at all) is advantageous since it ensures that a certain nip length can be defined such that the transfer zone can be limited. Moreover, a certain linear load improves stability in the nip which protects the web.

The second transfer nip roll 15 may suitably operate with an internal underpressure in the range of 10 kPa-70 kPa. This is a pressure range in which the web is reliably transferred and which helps the textured fabric 12 to give structure to the web. At the same time, it is not excessively high which could lead to unnecessarily high energy consumption.

In advantageous embodiments of the invention, the transfer nip TN is located at a distance of 1 m-7 m from the dewatering nip PN, preferably at a distance of 2 m-6 m.

Optionally, a vacuum box 16 may be arranged to act on the textured fabric 12 to further mold the fibrous web into the surface of the textured fabric 12 at a point between the transfer nip and the drying cylinder 17. The fibrous web is molded into the surface of the textured fabric by means of the vacuum (underpressure) in the vacuum box. Thereby, the structuring of the web may be improved such that the bulk is further increased. The vacuum box 16 may suitably operate at an underpressure of 20 kPa-70 kPa. This is deemed to be a suitable range for imparting further texture (three-dimensional structure) to the web. For some cases, the upper limit of the underpressure in the vacuum box 16 may be set to 60 KPa.

Figure 2:
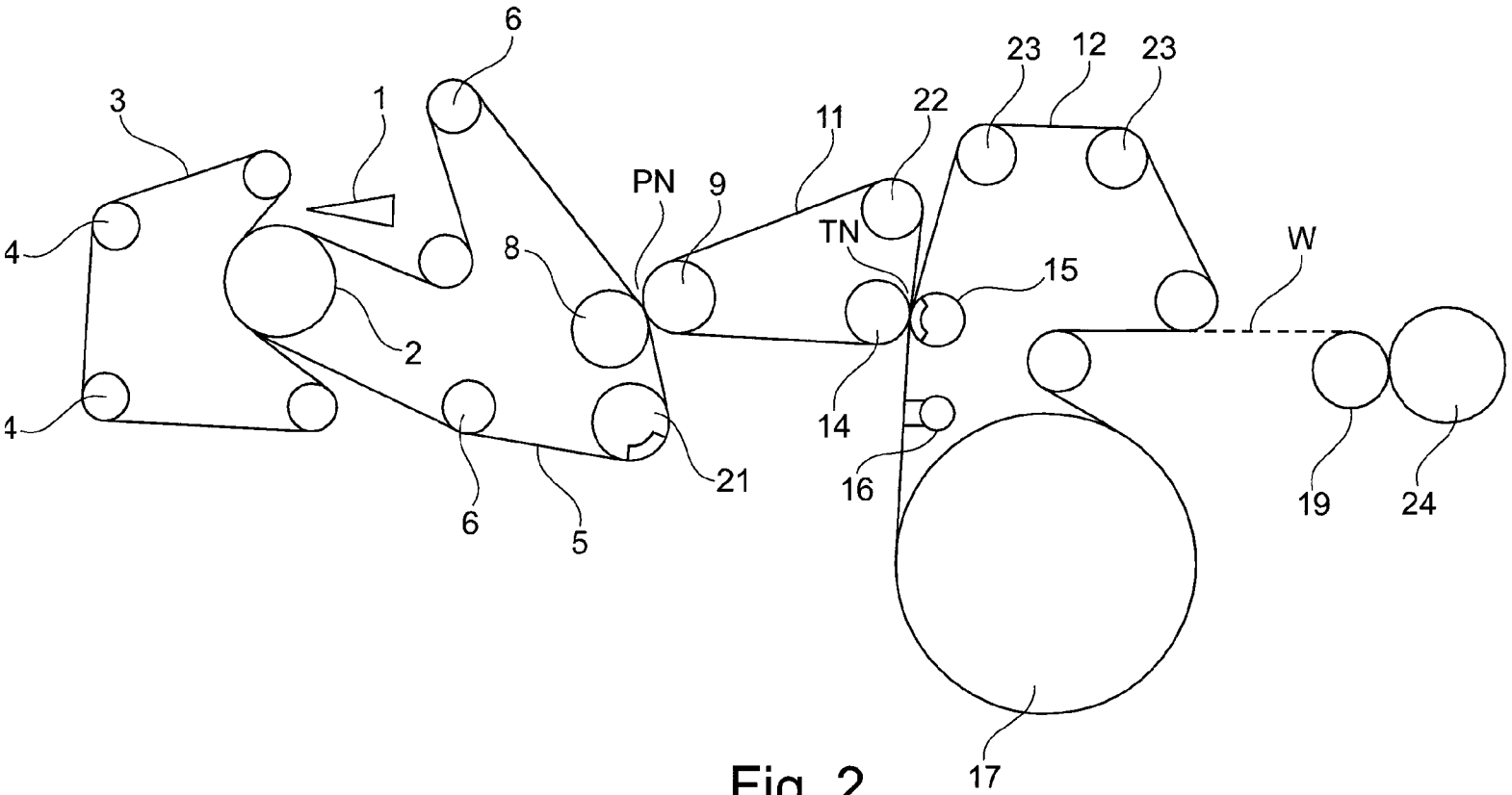
FIG. 2 shows a schematic side view of a second embodiment of the invention in which the drying cylinder is a through air drying cylinder.

With reference to FIG. 2, a second embodiment of the invention is shown. The embodiment of FIG. 2 is substantially similar to the embodiment of FIG. 1 except that the drying cylinder 17 is formed by a through air drying cylinder (TAD cylinder). In this embodiment, the textured fabric 12 is a through air drying fabric (TAD fabric) and hot air is blown from the inner of the cylinder 17 through the textured fabric 12. The textured fabric 12 wraps the drying cylinder 17 over a part of the circumference of the drying cylinder 17. The wrap angle may suitably be in the range of 160°-340°.

Figure 3:
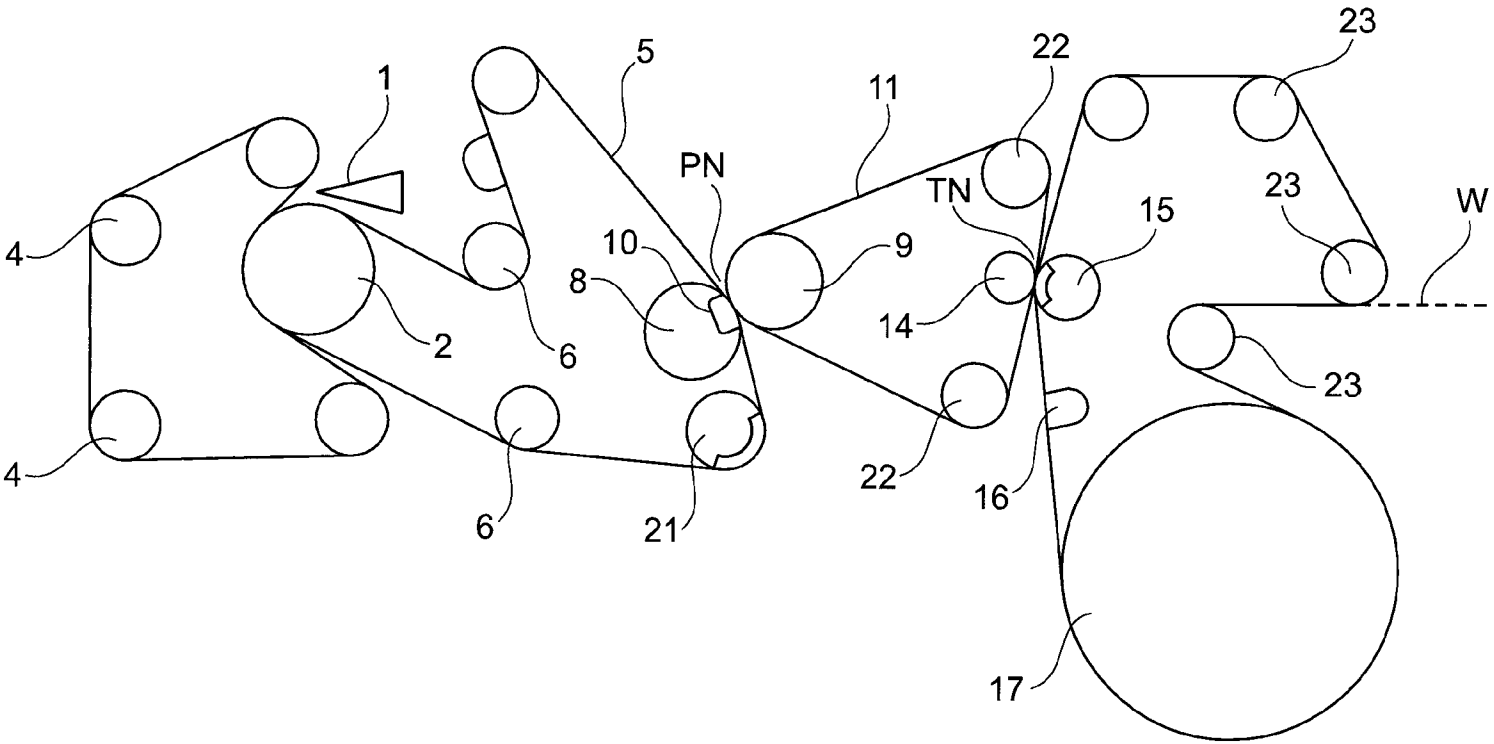
FIG. 3 is a schematic representation of a third embodiment of the invention which is similar to FIG. 2 except for one detail.

The embodiment of FIG. 3 is substantially similar to the embodiment of FIG. 2 but the first press unit 8 is here formed by an extended nip roll that may have an internal shoe 10 which is looped by a flexible belt. In all embodiments of the present invention, an extended op roll having an internal shoe looped by a flexible belt could be used. Such extended nip rolls (sometimes also referred to as shoe press rolls) are disclosed in the prior art, see for example U.S. Pat. Nos. 5,662,777, 6,083,352, 7,527,708 or EP 2085513. These documents disclose examples of extended nip rolls (shoe rolls) that could be used as extended nip rolls in the present invention. In the embodiment of FIG. 3, it is the first press unit 8 that is an extended nip roll but it should be understood that it could instead be the second press unit 9 that is an extended nip roll. In the same way, an extended nip roll could be used in the embodiment of FIG. 1 or FIG. 2. If one press unit 8, 9 is an extended nip roll, the other press unit 8, 9 could optionally be a deflection controlled roll (a deflection compensated roll) which is has a shell that is internally supported by shoes or by one or several hydraulic chambers.

In many embodiments, the dewatering nip is a nip using an extended nip roll. In such embodiments, the linear load in the dewatering nip may be in the range of 200 kN/m-1000 kN/m, preferably 300 kN/m-800 kN/m. However, peak pressure in the dewatering nip is more important than linear load. The peak pressure is the highest pressure in the nip (the actual pressure typically varies in the machine direction). Suitably, the peak pressure may be in the range of 2 MPa-8 MPa. Preferably, the peak pressure should be in the range of 4 MPa-7 MPa. Generally, a higher linear load can be used when an extended nip roll is used such that the dewatering nip is an extended nip (such as a nip formed between a shoe press roll and a cylindrical counter roll). This is because an extended nip roll makes it possible to distribute the linear load over a larger nip area such that the peak pressure becomes lower than in a nip between two conventional rolls. At a given nip length, the average pressure is determined by the linear load. Peak pressure is determined not just by the linear load and nip area but also by the geometry of the nip which can determine pressure distribution. The linear load, and thereby the pressure in the nip, should be high enough to press out as much water as possible since a high dry solids content before the drying cylinder reduces the energy consumption for the drying cylinder (less water must be evaporated). However, a high linear load with a correspondingly high peak pressure may reduce the bulk of the fibrous web; the caliper (thickness) of the web is reduced which is undesirable. Tissue paper should preferably have a high bulk, i.e. a high caliper also when the basis weight is low. In many realistic embodiments, the linear load in the dewatering nip may be in the range of 350 kN/m-700 kN/m when one of the press units 8, 9 is an extended nip roll (depending on nip length). For example, the linear load could be in the range of 400 kN/m-600 kN/m. The peak pressure should not exceed 8 MPa since a higher peak pressure is likely to cause significant reduction of bulk. If the dewatering nip is a roll nip which does not include an extended nip roll, the nip length will be shorter which may make it necessary to use a smaller linear load. In many cases, it may be suitable to limit the peak pressure to 7 MPa. At the same time, if the linear load and the pressure is too low, dewatering will not be so effective. Therefore, the pressure should be allowed to rise such that peak pressure reaches at least 2 MPa and preferably to 4 MPa.

Figure 4:
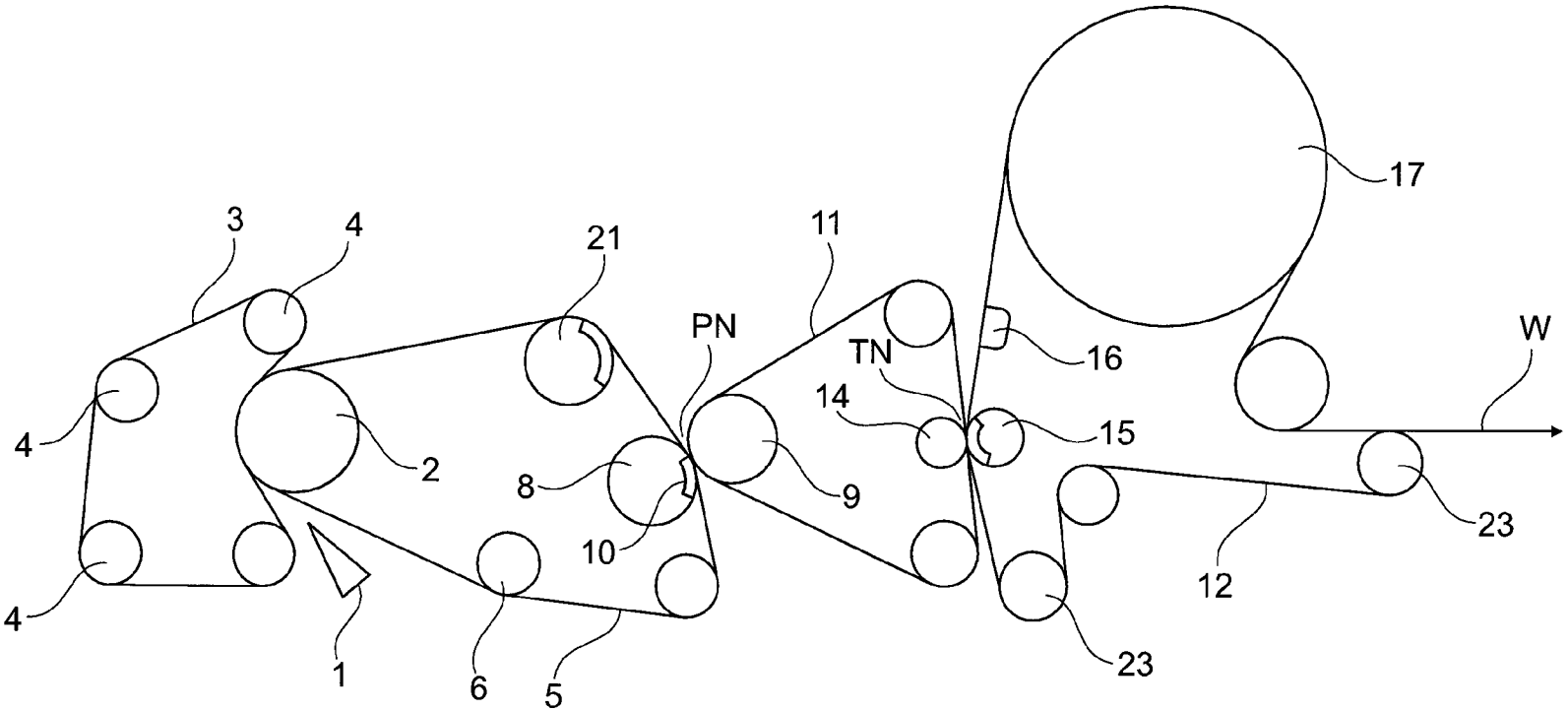
FIG. 4 is a schematic representation of yet another embodiment.

The embodiment of FIG. 4 is substantially similar to the embodiment of FIG. 3 but here the forming section has been designed differently and the drying cylinder 17 (which is also here a through air drying cylinder) is placed in a high position (as opposed to the lower position in FIG. 3).

Figure 5:
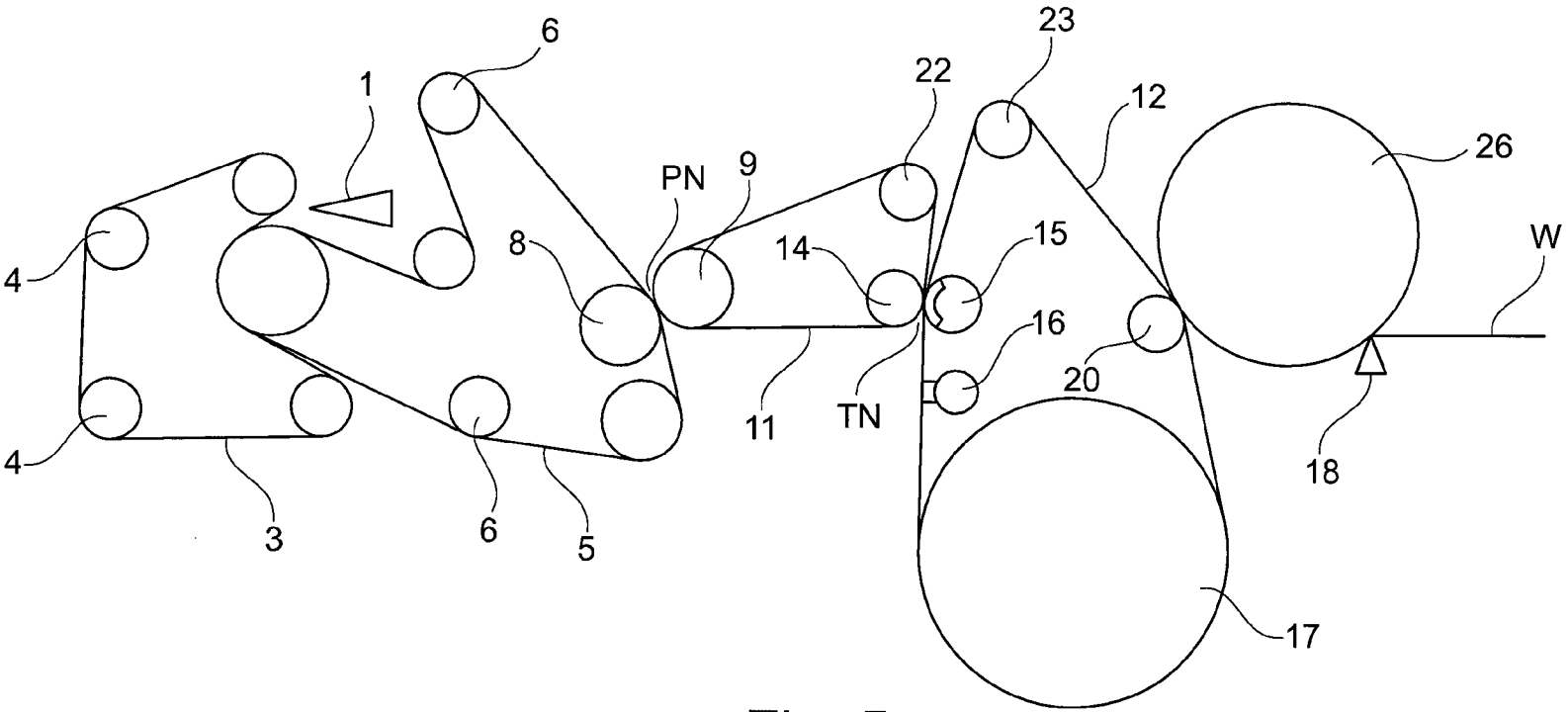
FIG. 5 is a schematic representation of an embodiment in which a Yankee drying cylinder is used in combination with a through air drying cylinder.

In the embodiment of FIG. 5, the layout is similar to that of FIG. 4 but in this is embodiment, the drying cylinder 17 which is a through aft drying cylinder is followed by a second drying cylinder 26 which is a Yankee drying cylinder. A nip roll 20 within the loop of the textured fabric 12 forms a nip with the second drying cylinder 26. In this nip, the web W is transferred to the Yankee drying cylinder from which it is creped by a doctor blade 18.

In all embodiments, the dewatering nip may be an extended nip or a short roll nip.

The use of a short transfer nip which is 5 mm-40 mm reduces the risk that the web is damaged during transfer to the textured fabric. By using a polyurethane-covered belt that is wider than the textured fabric, the textured fabric is also protected in the transfer nip and the risk of damage to the textured fabric is reduced. Thereby, also the risk of damage to the web in the transfer nip is reduced since a damaged textured fabric could cause damage to the web, especially during transfer of the web.

In those embodiments where the textured fabric is a through air drying fabric (a TAD fabric), this fabric may be, for example, such a fabric as is sold by Albany International under the name Prolux 003 or under the name ProLux 005.

The invention is primarily intended for such tissue paper grades that have a basis weight in the range of 10 g/m$^2$-30 g/m$^2$ but in some cases, it can be used also for papers with even lower weight, e.g. down to 7 g/m$^2$. Normally, it would be used for papers with a basis weight in the range of 14 g/m$^2$-28 g/m$^2$. The indicated ranges for basis weight refer to the weight of the ready-dried web, i.e. the basis weight of the paper that is rolled to a paper roll on a reeling drum.

The endless belt 11 that is used should have smooth surface but the surface may have micro-scale depressions and it may be, for example, such a belt as is described in U.S. Pat. No. 7,811,418.

A belt which is a suitable choice for the endless belt 11 is sold by Albany International under the name Transbelt®.

Embodiments are conceivable in which the fibrous web is formed between two forming wires and subsequently conveyed from one of the forming wires to the felt that passes through the dewatering nip. However, it is preferable that the felt that passes through the dewatering nip is also one of the fabrics used in the forming section. Such a design makes the layout of the machine shorter and simpler. Less space will be required for the machine.

In one trial that was made with a machine configuration according to FIG. 1 in which an extended nip roll was used in the dewatering nip PN, linear load in the dewatering nip was 450 kN/m. The transfer nip TN used a suction roll where the underpressure was 20 kPa. A vacuum box like the vacuum box 16 in FIG. 1 was also used. The underpressure in the vacuum box was 20 kPa. The rush transfer in the transfer nip took place with a speed difference of 15% (the endless belt was running at a speed 15% higher than the speed of the textured fabric 12). At a basis weight of 18,8 g/m$^2$, the caliper obtained was 329 which means a high bulk.

Figure 7:
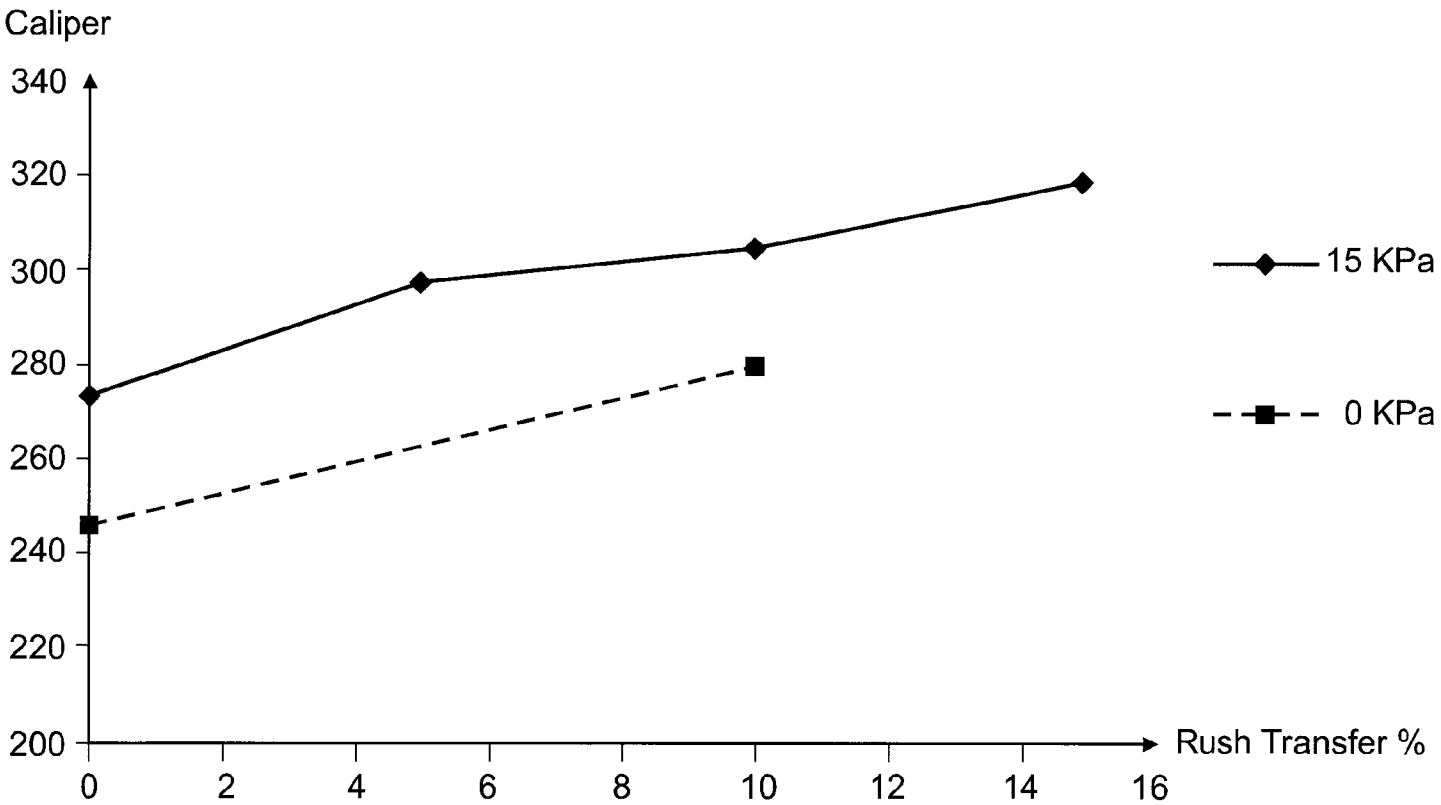
FIG. 7 is a diagram showing the effect of speed difference and underpressure on the caliper of the ready-dried fibrous web.

In FIG. 7, it can be seen how caliper is affected by the speed difference and by the underpressure in the vacuum box 16. In FIG. 7, the horizontal axis represents the degree of rush transfer, i.e. the speed difference while the vertical axis represents caliper of the fibrous web when it has been dried to final dryness. The upper graph shows a case in which the underpressure in the vacuum box is kept at 15 KPa. The lower graph (interpolated from two measurement values) shows a case in which the underpressure is zero (or in which no vacuum box 16 is used at all). As can be seen in the figure, the caliper improves with increasing speed difference in both cases. However, the use of an underpressure of 15 KPa results in higher caliper right from the beginning. As can be seen in FIG. 7, the use of an underpressure of 15 KPa in the vacuum box consistently improves caliper by about 25 μm in the tested ranges.

The invention can be used for applications where the speed difference in rush transfer (the speed difference in the transfer nip TN) is larger than 8%. By using a transfer nip with a nip length which does not exceed 40 mm for transferring the fibrous web to the textured fabric 12, it is possible to achieve web transfer at higher speed differences than 8%. However, the invention can also be applied to such cases where the speed difference is lower than 8% in order to reduce the risk that the web be damaged in the transfer nip TN. There are cases where the invention may be useful even when the speed difference is only 5%.

The invention claimed is:

1. A method of producing a structured fibrous web of paper, the method comprising the steps of:

forming a fibrous web and conveying the formed fibrous web on a water receiving felt to a dewatering nip formed by a first press unit and a second press unit and where an endless belt is passed through the nip together with the fibrous web and the water receiving felt, the endless belt having a side which is covered by polyurethane and which contacts the fibrous web in the dewatering nip;

after the dewatering nip, conveying the fibrous web by the endless belt to an endless textured fabric which is permeable to air and to which the web is transferred from the endless belt, the textured fabric running at a lower speed than the endless belt; and after the transfer to the textured fabric, conveying the fibrous web by the textured fabric to a drying cylinder, wherein the web is transferred from the endless belt to the textured fabric in a transfer nip, the transfer nip being formed between a first transfer nip roll that lies within the loop of the endless belt and a second transfer nip roll which is a suction roll located within the loop of the textured fabric, the transfer nip having a length in the machine direction which is in the range of 5 mm-40 mm.

2. A method according to claim 1, wherein the first transfer nip roll and the endless belt have a width that exceeds the width of the textured fabric.

3. A method according to claim 1, wherein the endless belt has a speed that is 5%-25% higher than the speed of the textured fabric.

4. A method according to claim 1, wherein the linear load in the transfer nip is in the range of 0.5 kN/m-15 kN/m.

5. A method according to claim 1, wherein the second transfer nip roll operates with an internal underpressure in the range of 10 kPa-70 kPa.

6. A method according to claim 1, wherein the endless belt has an air permeability that does not exceed 0.15 m/s.

7. A method according to claim 6, wherein the endless belt (11) is impermeable to water.

8. A method according to claim 1, wherein the textured fabric passes a vacuum box that operates at an underpressure such that the fibrous web is further molded into the surface of the textured fabric by the vacuum in vacuum box, the vacuum box being located at a point between the transfer nip and the drying cylinder and operating at an underpressure of 20 kPa-70 kPa.

9. A method according to claim 1, wherein the length in the machine direction of the transfer nip is in the range of 15 mm-40 mm.

10. A method according to claim 1, wherein the endless belt has a speed that is 10%-15% higher than the speed of the textured fabric.

11. A machine for producing a structured fibrous web of paper, the machine comprising;

a forming section that includes a first and a second forming fabric;

a dewatering nip defined by a first and a second press unit, through which dewatering nip a water receiving felt is arranged to carry a fibrous web formed in the forming section;

an endless belt arranged to run in a loop through the dewatering nip and having at least one side covered with polyurethane such that the polyurethane covered side will face the paper web that passes through the dewatering nip;

a textured fabric arranged to pick up the paper web from the endless belt at a point downstream of the dewatering nip; and a drying cylinder to which the textured fabric is arranged to carry the paper web; and a transfer nip in which the paper web is transferred from the endless belt to the textured fabric, the transfer nip being formed between and by a first transfer nip roll located within the loop of the endless belt and a second transfer nip roll which is a suction roll that is located within the loop of the textured fabric, the transfer nip having a nip length in the machine direction that is in the range of 5 mm-40 mm.

12. A machine according to claim 11, wherein the first transfer nip roll and the endless belt have a width that exceeds the width of the textured fabric.

13. A machine according to claim 12, wherein the first transfer nip roll and the endless belt (11) have a width that exceeds the width of the textured fabric by a range of 10 mm-300 mm.

14. A machine according to claim 11, wherein one of the first and second press units in the dewatering nip is an extended nip roll.

15. A machine according to claim 11 , wherein a vacuum box is arranged to act on the textured fabric to further mold the fibrous web into the textured fabric at a point between the transfer nip and the drying cylinder.

16. A machine according to claim 11, wherein the drying cylinder is a Yankee drying cylinder to which the paper web is transferred from the textured fabric in a second transfer nip formed between a nip roll and the Yankee cylinder; and in which a doctor blade is arranged to act on the Yankee cylinder.

17. A machine according to claim 11, wherein the drying cylinder is a through air drying cylinder which is wrapped by the textured fabric over a part of its circumference.

18. A machine according to claim 11, wherein the endless belt has an air permeability that does not exceed 0.15 m/s.

19. A machine according to claim 11, wherein the water receiving felt that passes through the dewatering nip is also one of the forming fabrics in the forming section.

20. A machine according to claim 11, wherein the nip length in the machine direction of the transfer nip is in the range of 15 mm-30 mm.

* * * * *